United States Patent [19]

Gomi et al.

[11] Patent Number: 5,058,765

[45] Date of Patent: Oct. 22, 1991

[54] MONEY CASE

[75] Inventors: Yoshiaki Gomi, Shizuoka; Mitsugu Okawa, Izunagaoka; Norihisa Taniuchi, Shizuoka, all of Japan

[73] Assignee: Tokyo Electric Co., Ltd., Tokyo, Japan

[21] Appl. No.: 680,793

[22] Filed: Apr. 3, 1991

Related U.S. Application Data

[63] Continuation of Ser. No. 472,812, Jan. 31, 1990, abandoned.

[30] Foreign Application Priority Data

Feb. 17, 1989 [JP] Japan ..... 1-37943

[51] Int. Cl.[5] ..... A47B 88/00

[52] U.S. Cl. ..... 220/528; 206/0.81

[58] Field of Search ..... 206/0.81, 0.84; 220/23.83, 23.86, 505, 528, 533, 542, 529

[56] References Cited

U.S. PATENT DOCUMENTS

| | | | |
|---|---|---|---|
| 1,325,525 | 12/1919 | Manny | 220/22.3 |
| 1,349,527 | 8/1920 | Owen | 206/0.81 |
| 1,840,485 | 1/1932 | Butler | 206/0.81 |
| 1,876,043 | 9/1932 | Bowman | 206/0.81 |
| 2,508,981 | 5/1950 | Williams | 206/0.81 |
| 2,610,759 | 9/1952 | Slade | 220/22.3 |
| 4,280,034 | 7/1981 | Ezaki et al. . | |
| 4,412,709 | 11/1983 | Ishii | 206/0.81 |
| 4,786,785 | 11/1988 | Felt . | |

FOREIGN PATENT DOCUMENTS

| | | | |
|---|---|---|---|
| 121710 | 10/1984 | European Pat. Off. . | |
| 157015 | 10/1985 | European Pat. Off. . | |
| 2618993 | 2/1989 | European Pat. Off. . | |
| 1168135 | 4/1964 | Fed. Rep. of Germany | 206/0.81 |
| 1172457 | 6/1964 | Fed. Rep. of Germany | 206/0.81 |
| 3249315 | 2/1984 | Fed. Rep. of Germany | 206/0.84 |
| 696424 | 9/1953 | United Kingdom | 220/22.3 |
| 1087408 | 10/1967 | United Kingdom . | |

OTHER PUBLICATIONS

IBM Technical Disclosure Bulletin, vol. 26, No. 10b, 3/84, New York, U.S., pp. 5773–5774, Kluewer et al., "Pop-Up Cash Box".

IBM Technical Disclosure Bulletin, vol. 29, No. 11, 4/87, New York, U.S., pp. 4996–4997, "Dividable Coin Till for Cash Drawer".

*Primary Examiner*—Steven M. Pollard

*Attorney, Agent, or Firm*—Oblon, Spivak, McClelland, Maier & Neustadt

[57] ABSTRACT

In the present invention a money case is provided with a drawer body having a plurality of open-top coin containers and a plurality of open-top bank note containers arranged therein and adapted to be received into a box-like body. The money case includes at least one coin case and one bank note case with a bank note holding surface formed therein for holding bank notes such that they stand on their edges, in which the coin case and the bank note case are adapted to be selectively positioned in the drawer body and suitably set thereto by a setting mechanism.

6 Claims, 4 Drawing Sheets

MONEY CASE

This application is a Continuation of application Ser. No. 07/472,812, filed on Jan. 31, 1990, now abandoned.

BACKGROUND OF THE INVENTION

1. Field of the Invention

The present invention relates to a money case to be utilized for a drawer of an electronic register or the like.

2. Discussion of the Background

A prior art example of a money case will be described according to FIG. 6 and FIG. 7. The money case 1 forms a drawer 3 capable of sliding out of and into a boxlike body 2. The interior of the money case 1 is partitioned lengthwise and crosswise. In the front portion of the money case 1, there are formed four coin containers 5 whose bottom plate is continuously curved toward the open top so that coins 4 contained therein may be easily taken out. In the money case 1 at the rear of the coin containers 5, there are formed three banknote containers 8 each of which are provided with a bank note hold-down member 7 supported for swinging back and adapted to press and hold bank notes 6 from above.

With the money case 1 of such arrangement, coins 4 and bank notes 6 are sorted according to their kinds and put into their respective coin containers 5 and bank note containers 8. When an operator puts bank notes 6 into the money case 1, the bank notes 6 are horizontally piled up within the bank noter container 8 while the bank note hold-down member 7 is pushed up by the operator with the finger or the like.

With such money case 1, coins 4 and bank notes 6 can be stored sorted according to their kinds and, hence, money handling can be done quickly. However, since the money case 1 has the interior of the case partitioned to provide the containers 5 and 8 for storing money, it is impossible to change the arrangement of the containers. Therefore, it is not possible to exchange the positions of the coin containers 5 and the bank note containers 8 with each other according to frequencies of use of different kinds of money. This has made the money case 1 inconvenient for use. Further, since, in the described money case 1, the bank notes 6 are contained in the bank note container 8 piled up horizontally and pressed down by the bank note hold-down member 7, it is not easy to put in and take out bank notes 6. Further, since the bank notes 6 are piled up horizontally, considerable base space is required for the bank note containers 8. This has prevented a drawer 3 from being made smaller in size and made it unavoidable that electronic registers and the like occupy considerable space.

SUMMARY OF THE INVENTION

A first object of the present invention is to make it possible to suitably arrange the coin containers and bank note containers within a drawer.

A second object of the present invention is to make putting in and taking out of bank notes easier.

A third object of the present invention is to reduce the required base area.

The present invention, in a money case with a plurality of open-top coin containers and a plurality of open-top bank note containers arranged therein and adapted to be received into a boxlike body, comprises at least one coin case and at least one bank note case with a bank note holding surface provided therein for holding bank notes such that they stand on their edges and also comprises means for selectively positioning and setting the coin case and the bank note case within the drawer. Thus, by providing at least one coin case and at least one bank note case with a bank note holding surface provided therein for holding bank notes such that they stand on their edges and further providing the means for selectively positioning and setting the coin case and the bank note within the drawer, the coin case and the bank note case can be at desired positions in the drawer. Therefore, it becomes possible to change the arrangement of the cases according to such conditions as frequencies of use of coins and bank notes, and since the bank notes can be stored such that they stand on their edges, depositing and withdrawal of the bank notes is made easier and the base area of the bank note case is made smaller.

DESCRIPTION OF THE PREFERRED EMBODIMENTS

Figure 7:
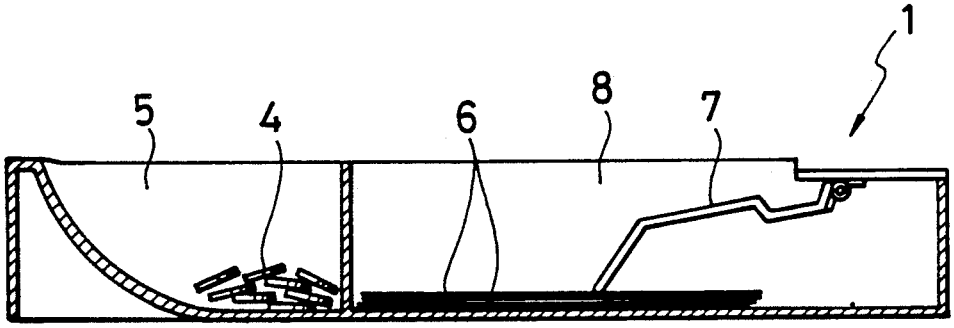
FIG. 7 is a longitudinal sectional side view of FIG. 6.

One embodiment of the present invention will be described below with reference to FIG. 1 to FIG. 5. Throughout the drawings, like or corresponding parts to those in the above described prior art example will be denoted by like names and reference numerals and explanation thereof will be omitted. The present money case 9 has a drawer body 9*a* which is provided with projections 11 as setting means disposed along both side edge portions 10 thereof at successive intervals. On the other hand, there is provided a coin case 14 having recesses 12 as setting means to engage with the aforesaid projections 11 formed at both sides of its top portion and having a plurality of juxtaposed coin containers 13 formed therein, which coin container is of virtually the same shape as the coin container 5 of the money case 1 illustrated in FIG. 7. Further, there is provided a stationary bank note case 16 having recesses 12 as setting means to engage with the aforesaid projections formed at both sides of its top portion and having a bank note holding surface 15 formed in the front thereof, which bank note holding surface is tilted forward and holds bank notes 6 which are placed therein. The bank note case 16 is further provided with a rugged surface 17 on the bottom to prevent the bank note 6 from slipping and also provided with a stopper 18 erected in the rear of the bottom. In the front plate of the money case 9, there is made a media slot 19 so that merchandise coupons 20 and the like can be put in without removing the coin case 14 and the like.

Further, the length of the edges at both sides of the coin case 14 and the length of the edges at both sides of the bank note case 16 are both arranged to be integral multiples of the pitch of the projections 11 disposed along the edge portions at both sides of the drawer body 9*a*. Hence, in whatever order the cases may be arranged in the drawer body 9a, there is produced no gap between the cases.

Figure 6:
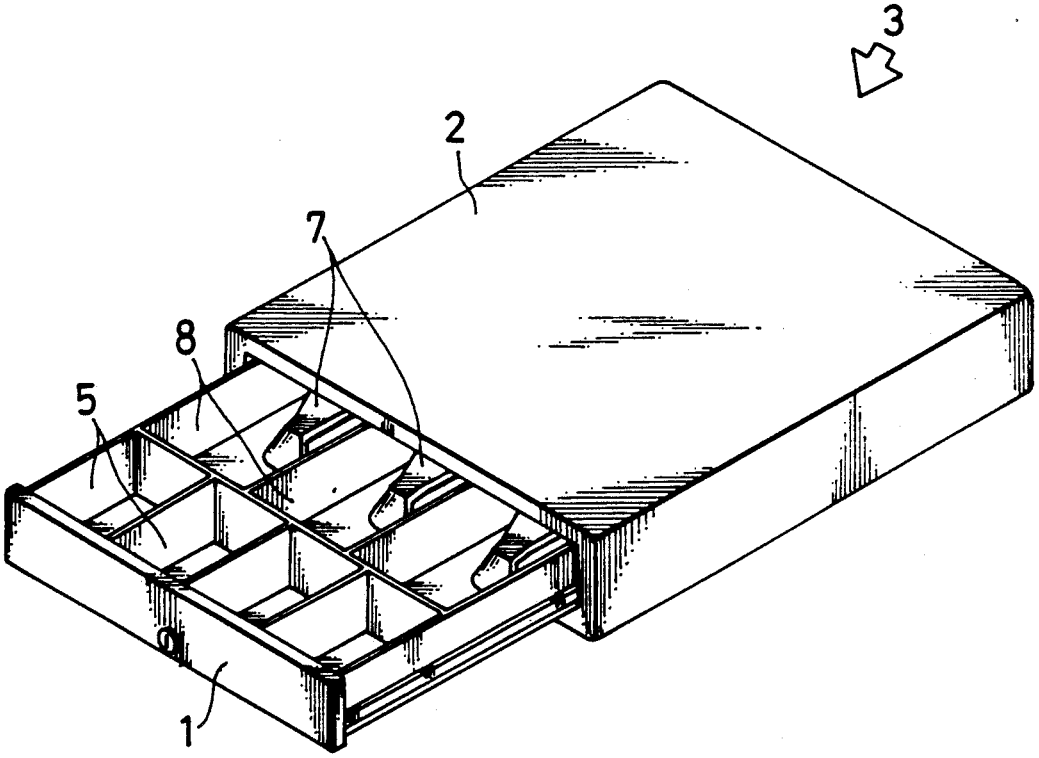
FIG. 6 is a perspective view of a prior art example.

With the described arrangement, the money case 9 functions the same as the money case 1 illustrated in FIG. 6. When a bank note 6 is to be put into the money case 9, the bank note 6 is horizontally held and cast into the bank note case 16 obliquely. Then, the bank note 6 is stored in the bank note case 16 held by the bank note holding surface 15 and kept from slipping on the bottom surface by means of the ragged edges 17. At this time, the bank notes 6 are obliquely held parallel to each other with their edges exposed upward, and hence, a required number of bank notes 6 can be easily picked out. In the money case 9 of the present embodiment, the bank note holding surface 15 of the bank note case 16 is tilted, and hence, depositing in and picking out of the bank notes 6 can be smoothly done and also the money case 9 can be made thinner.

Further, since, in the present money case 9, the coin case 14 and the bank note case 16 are adapted to be placed in the money case 9 engaged therewith, arrangement of these cases can be changed as required.

Figure 1:
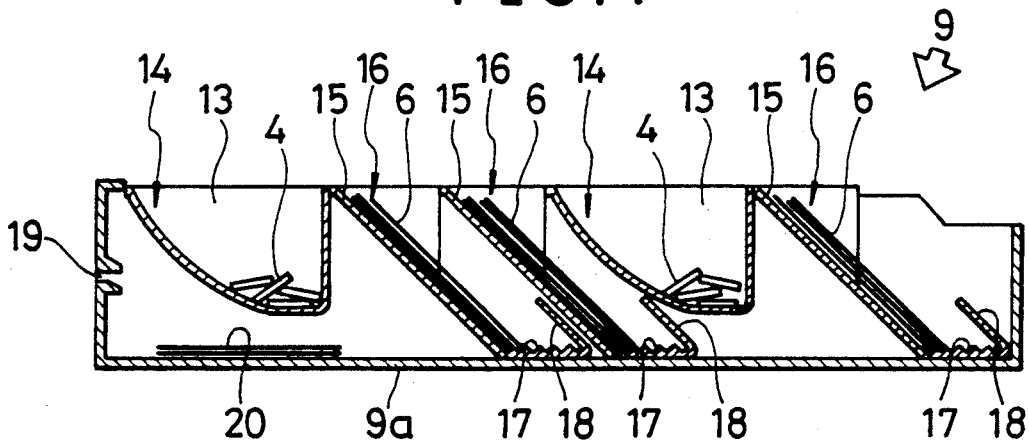
FIG. 1 is a longitudinal sectional side view of an embodiment of the present invention.
Figure 2:
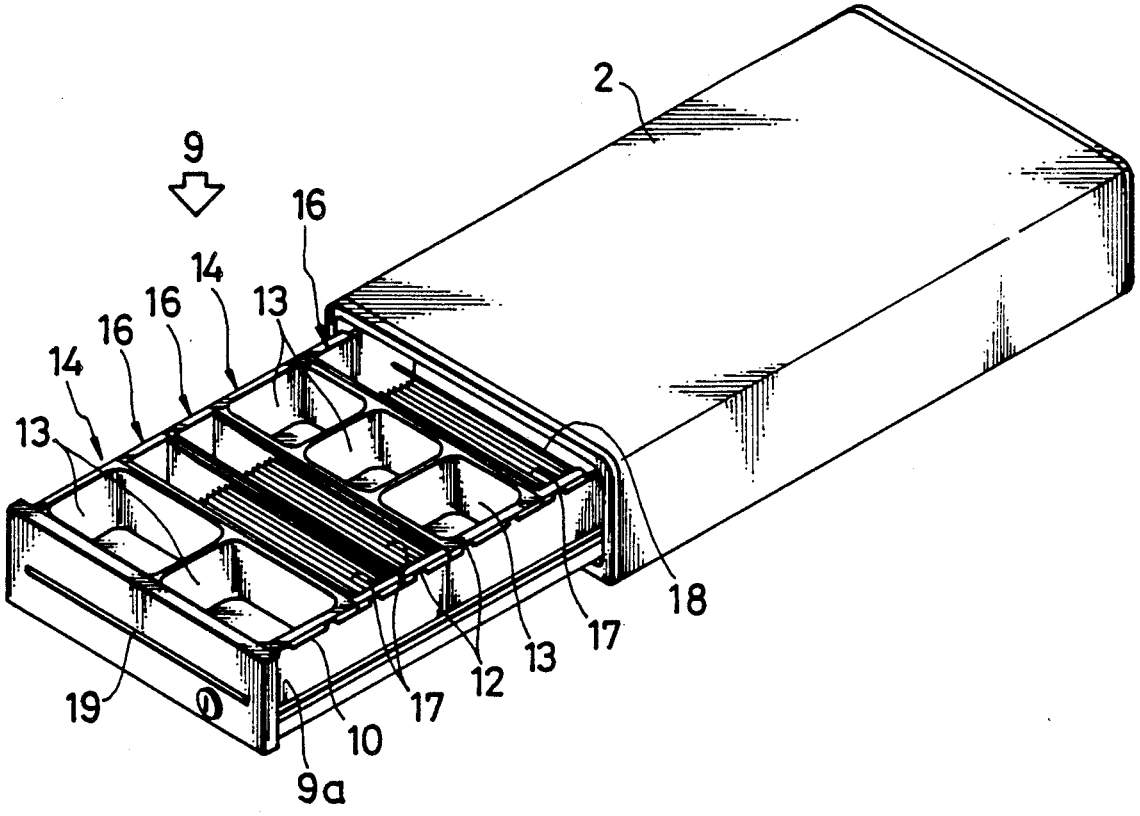
FIG. 2 is a perspective view.
Figure 3:
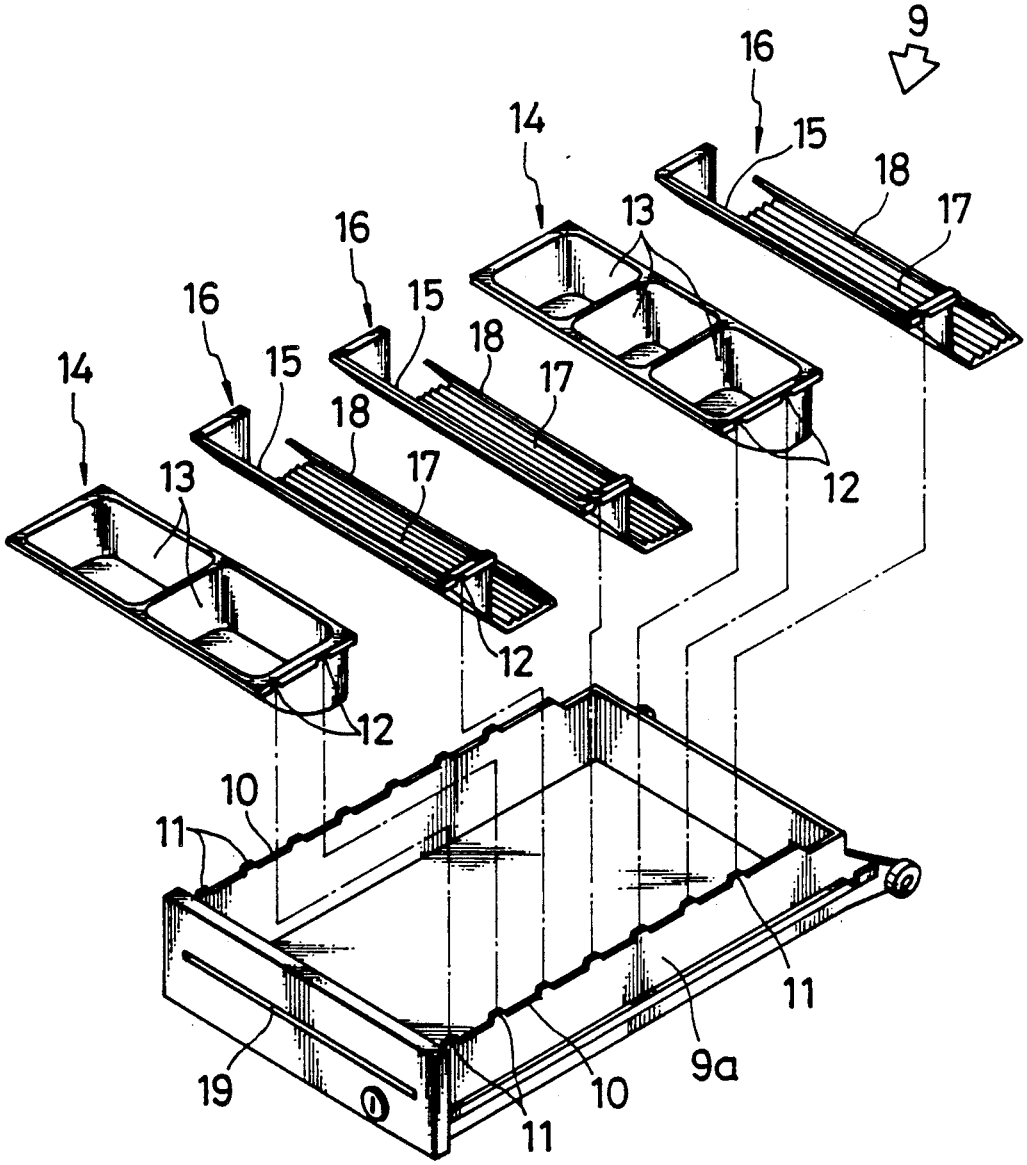
FIG. 3 is an exploded perspective view.
Figure 4:
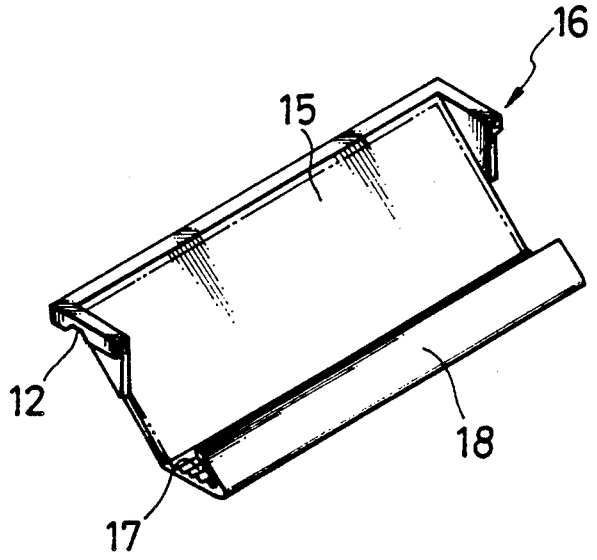
FIG. 4 is a perspective view of a bank note case.
Figure 5:
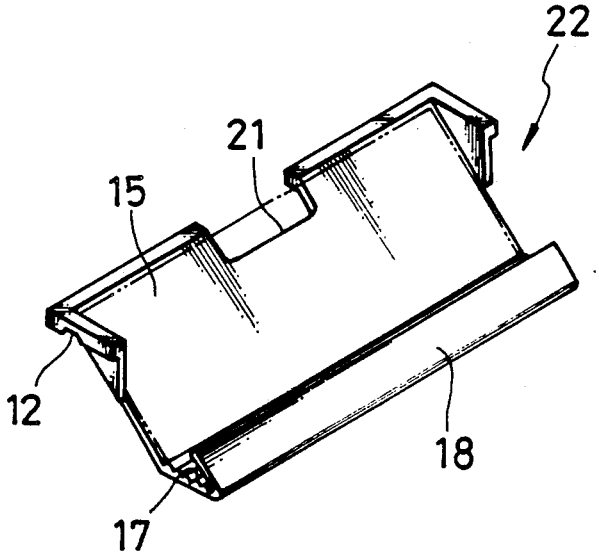
FIG. 5 is a perspective of another example of the bank note case.

Also, a bank note case 22 with a cut and hollowed portion 21 made in the bank note holding surface 15 at its upper edge portion as shown in FIG. 5 may be considered. In this design, the operator (not shown) can pick out the bank notes 6 easily from the cut portion 21 and, hence, the bank notes 6 can be handled more quickly.

Besides, since the bank notes can be stored in the bank note case 16 held sideways and such that they stand on their edges, the base area can be made smaller. Hence, even if a plurality of the bank note cases 16 are used, the overall base area can be made considerably small, and thus, the overall money case can be provided in a small size.

Obviously, numerous modifications and variations of the present invention are possible in light of the above teachings. It is therefore to be understood that within the scope of the appended claims, the invention may be practiced otherwise than as specifically described herein.

What is claimed is:

1. A money case which comprises;

a box-like body, a drawer body adapted to slide into and out of said body in the horizontal direction, a coin case with a first and second coin container formed therein, a bank note case with a bank note holding surface formed therein, said bank note holding surface horizontally along their longitudinal direction; and setting means for allowing said coin case and said bank note case to be selectively stationarily positioned with respect to said drawer body and set therein.

2. A money case according to claim 1, wherein said bank note case has a tilted bank note holding surface formed therein.

3. A money case according to claim 1, wherein said bank note case has a cut and hollowed portion at an upper edge portion thereof.

4. A money case according to claim 1, wherein said drawer body has a plurality of projections formed with a uniform pitch along the edge portions of opposite sides thereof and said coin case and said bank note case are provides with recesses for engaging with said projections.

5. A money case according to claim 4, wherein dimensions of the edge portions of opposite sides of the coin case and the edge portions on opposite sides of the bank note case are set so as to be integral multiples of the pitch of the projections formed along edge portions of the opposite sides of said drawer body.

6. A money case as set forth in claim 1, wherein said bank note holding surface includes a ragged edged bottom surface for supporting said bank notes on edge portions thereof and wherein said bank not case comprises a case positioned between said first and second coin container.

* * * * *